United States Patent [19]

Nickell et al.

[11] Patent Number: 5,056,442

[45] Date of Patent: Oct. 15, 1991

[54] TIGHT END DETECTOR FOR TUFTING MACHINES

[75] Inventors: Lawrence C. Nickell, Fairlea; Curtis L. Perkins, Ronceverte, both of W. Va.

[73] Assignee: Appalachian Electronic Instruments, Inc., Ronceverte, W. Va.

[21] Appl. No.: 567,172

[22] Filed: Aug. 14, 1990

[51] Int. Cl.[5] ..... B69H 63/04; D05C 15/04

[52] U.S. Cl. ..... 112/80.18; 112/273; 112/278; 200/61.18; 28/187

[58] Field of Search ..... 112/80.18, 80.01, 273, 112/278; 28/187; 66/163; 200/61.18, 61.13; 340/677, 668; 139/353, 354; 57/81

[56] References Cited

U.S. PATENT DOCUMENTS

| | | | |
|---|---|---|---|
| Re. 24,541 | 11/1956 | Koenig | 200/86 R |
| 3,221,683 | 12/1965 | Abelsma | 112/80.18 |
| 3,850,122 | 11/1974 | Daeli | 200/61.18 X |
| 4,571,582 | 2/1986 | Walter | 340/677 |
| 4,710,646 | 12/1987 | Curda et al. | 340/677 X |
| 4,935,999 | 6/1990 | Lindemann | 28/187 |
| 4,970,974 | 11/1990 | Price | 112/80.18 |

FOREIGN PATENT DOCUMENTS

| | | | |
|---|---|---|---|
| 1226864 | 10/1966 | Fed. Rep. of Germany | 112/278 |
| 2819951 | 11/1978 | Fed. Rep. of Germany . | |
| 2908471 | 3/1979 | Fed. Rep. of Germany . | |

*Primary Examiner*—Peter Nerbun

*Attorney, Agent, or Firm*—Mason, Fenwick & Lawrence

[57] ABSTRACT

A tight end detector for tufting machines is disclosed which includes a modular switch bar assembly, a switch contact forming PC board thereon having a conductive stripe, insulating strip, a leaf-metal electrical contact member having parallel contact finger formations overlying the conductive stripe of the PC board and a thin cover layer overlying the bar, PC board, insulating strip, and electrical contact member to provide a wear surface against which yarn ends of the tufting machine may bear.

9 Claims, 3 Drawing Sheets

TIGHT END DETECTOR FOR TUFTING MACHINES

BACKGROUND AND OBJECTS OF THE INVENTION

The present invention relates in general to tension-responsive detecting devices for use in carpet making machines, and more particularly to tight end detecting devices for attachment to tufting machines for sensing tight ends prior to end breakage and stopping the machine.

It is heretofore been recognized that it is desirable to provide means on tufting or carpet making machines to detect and respond to tight ends promptly and stop the machine to prevent production of seconds or defective carpeting material due to low-lines. The main cause of end breaks on a tufting machine is the occurrence of tight ends caused by yarn hanging on the back of the package or package holder. One solution to this problem is to detect the tight end and stop the tufting machine before the end breaks. If the tight end is detected quickly enough, the machine can be stopped before the end breaks. The operator can then release the end which has become tightened to or beyond a pre-determined tension level, and thereby eliminate rethreading and mending. Also, it is desirable to promptly detect a piece of yarn which becomes tight because of excess lint in the yarn tube or for some other reason causing tightening of the yarn beyond a predetermined level, to immediately stop the machine to prevent seconds or defective carpeting from being produced.

An object of the present invention is the provision of a durable and highly reliable tight end detector for tufting machines, adapted to be mounted on the tufting machine between the tube bar and the first eye board, over and through which the yarns are drawn to the tufting machine, which will detect the tight end quickly enough to permit stoppage of the machine before the end breaks, and which can be arranged in a manner which quickly indicates the area where the tight end occurs.

Another object of the present invention is the provision of a tight end detector for tufting machines as described in the preceding paragraph, which includes a switch bar assembly of rugged, generally rectangular, tubular cross sectional bar form, and which can be made in modules which may be assembled in elongated tight end detector bar assemblies of various lengths to span various widths of yarn sheets.

Yet another object of the invention is the provision of a novel tight end detector for tufting machines a described in the immediately preceding paragraphs, wherein indicating lights are associated with each module or end detector bar section providing plural indicating lights to indicate the zone where the tight end occurs by illuminating the light associated with the particular module or segment sensing the tight end, so that the operator can find the tight end quickly.

Other objects, advantages and capabilities of the present invention will become apparent from the following Detailed Description, taken in conjunction with the accompanying drawings illustrating a preferred embodiment of the invention.

DETAILED DESCRIPTION OF A PREFERRED EMBODIMENT

Figure 1:
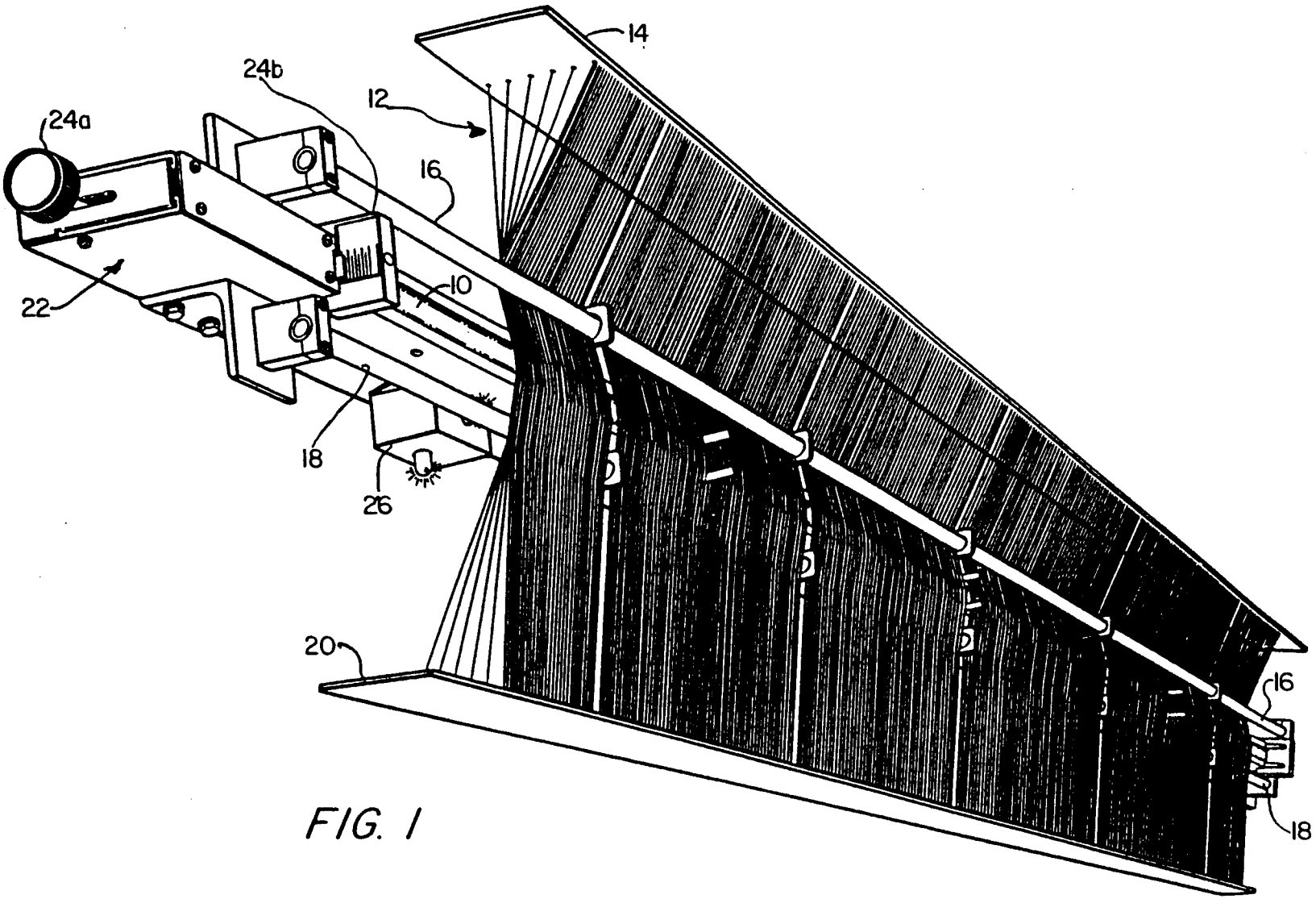
FIG. 1 is a perspective view of a plural module tight end detector assembly of the present invention, showing adjacent yarn ends and guides in a carpet or tufting machine installation.

Referring to the drawings, wherein like reference characters designate corresponding parts throughout the several figures, and particularly to FIG. 1, there is shown a tight end detector bar assembly, generally indicated by the reference character 10, mounted in working position in the yarn feed path of yarns leading to a tufting machine (not shown). The plural yarns being fed to the machine are indicated generally by the reference character 12 and are shown as extending through eyes or openings in a creel header 14 and about a pair of spaced, parallel elongated fixed hold-down bars 16, 18 and then to the top guide 20 leading to the tufting machine. The tight end detector bar assembly 10 of the present invention is positioned substantially midway between the two hold-down bars 16 and 18 as shown, and is mounted on a supporting rail, generally indicated at 22, which may include, in the preferred embodiment, a sensitivity adjustment structure of known construction including a sensitivity adjustment knob **24*a* and a sensitivity scale/pointer 24*b*. Light indicators 26 are provided along the supporting rail 22 to indicate the segment or modular section of the tight end detector bar assembly wherein a tight end occurs, as later described. The tight end detector bar assembly is mounted on the creel header between the header and the top guide as described, and is preferably mounted on screw jacks provided in the supporting rail 22 which are moved in and out toward the yarn sheet in the sensing zone between the hold-down bars 16, 18 by turning the knob 24*a* counterclockwise or clockwise, thus moving the switch tight end detector bar assembly 10** in and out and thereby adjusting the attack angle at which the yarns approach the contact surface of the tight end detector bar assembly.

Figure 4:
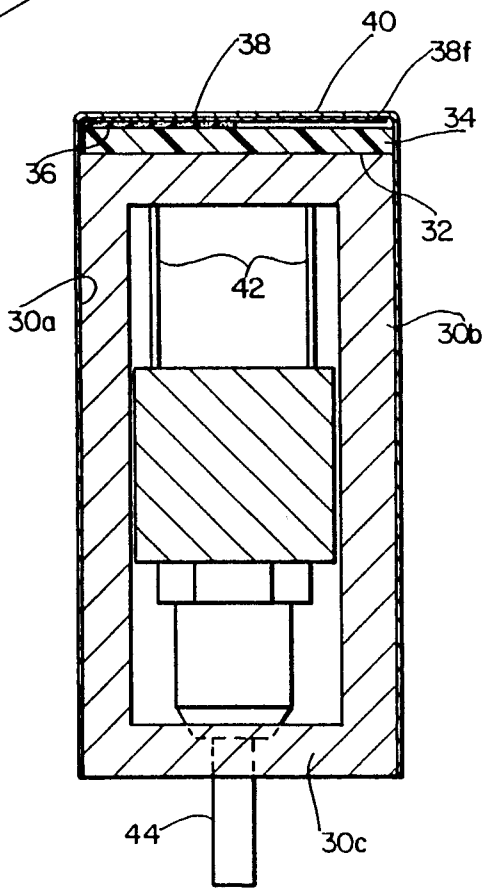
FIG. 4 is an enlarged vertical section view of the tight end detector bar, taken along the line 4—4 of FIG. 2.
Figure 2:
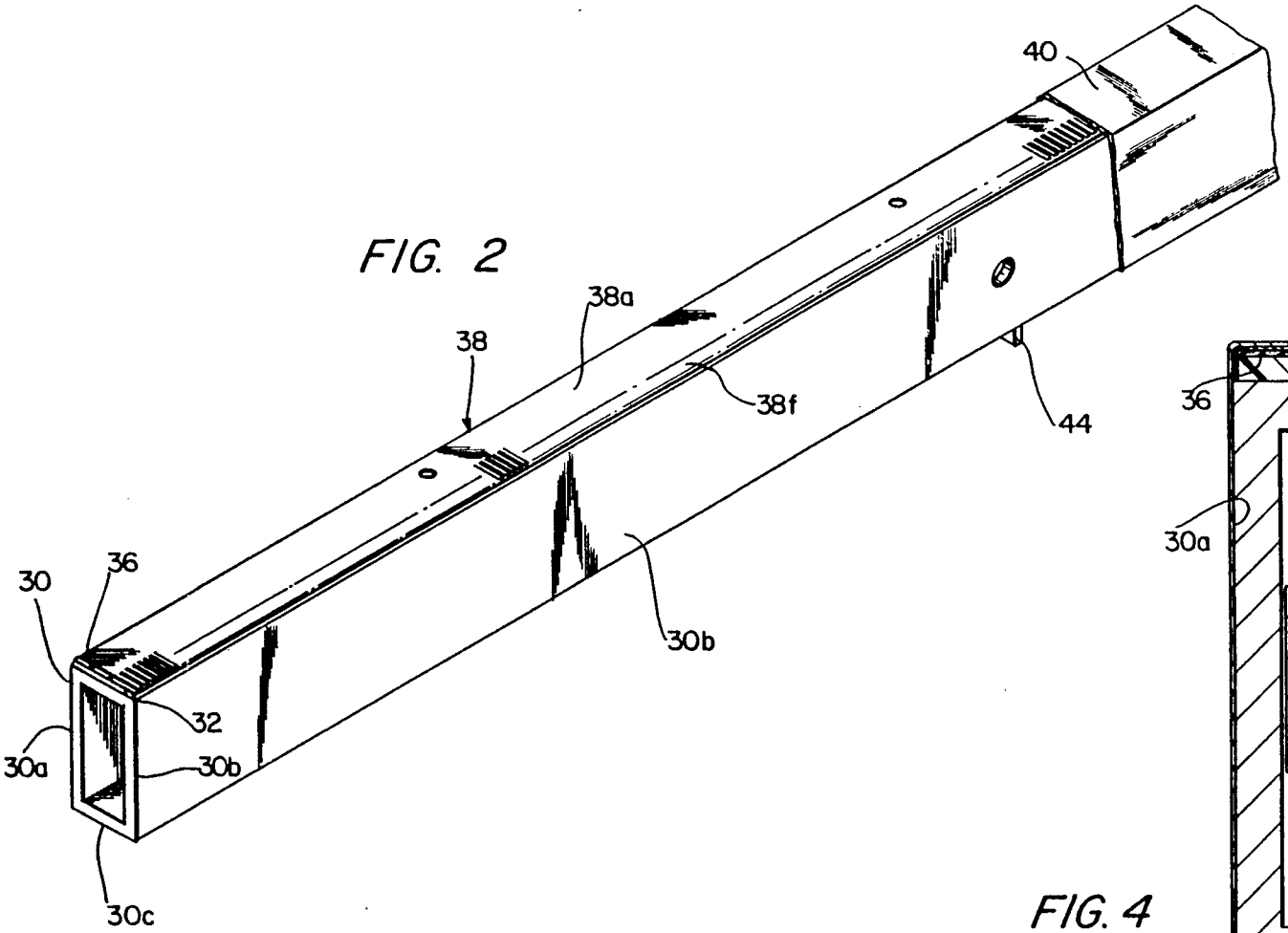
FIG. 2 is a perspective view of one modular section of the tight end detector bar structure, with parts broken away.
Figure 3:
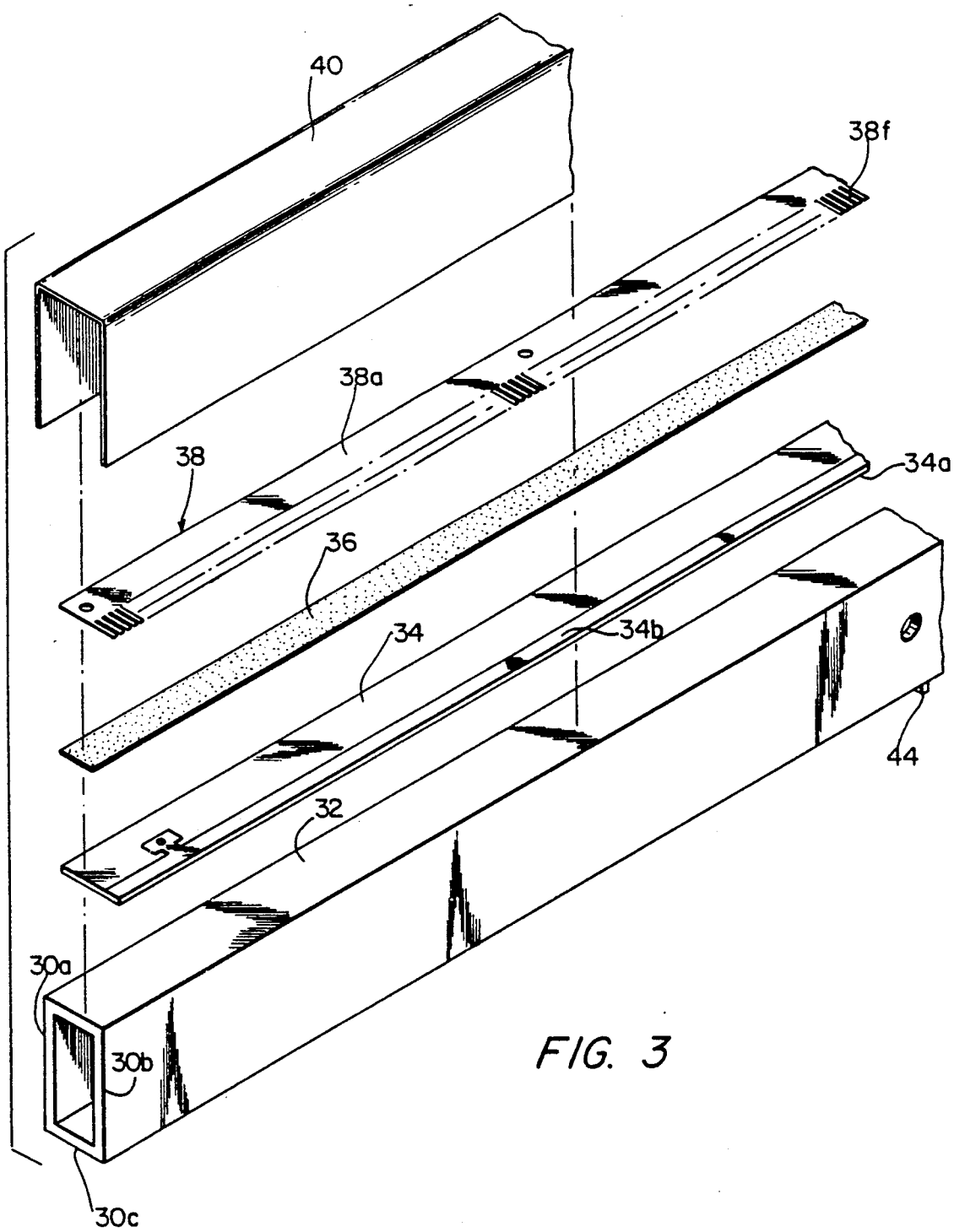
FIG. 3 is an exploded perspective view of the tight end detector of FIG. 3.

The tight end detector assembly is in bar form, as is apparent from FIGS. 2, 3 and 4, and comprises an elongated hollow rectangular tubular bar, indicated by reference character 30, which is of rectangular cross section as shown, formed for example of aluminum or suitable metal, and includes a top wall defining flat planiform top surface 32, at the yarn-contacting face thereof forming the upper or top face as viewed in FIGS. 2, 3 and 4. The bar 30 includes integral side and bottom walls forming leading side **30*a*, trailing side 30*b*, and bottom 30*c*. Surmounted on this flat planiform top face 32 is a lower electrical-contact-forming printed circuit (or PC) board 34 having a narrow stripe-like layer of electrically conductive material, indicated by reference character 34*b*, extending over a narrow region widthwise of the switch contact PC board 32 at the upper surface of the dielectric panel portion thereof and adjacent the trailing edge 34*a* thereof (the edge at which the yarns leave the bar during their travel toward the top guide 20 and tufting machine). The switch contact PC board 34 with its narrow stripe electrically conductive layer 34***b* forms the stationary switch contact member of the switch assembly. A double back tape strip, indicated at 36, of dielectric or insulating material is surmounted on the upper face of the PC board member 34 over approximately half of the width thereof extending from the leading edge relative to yarn travel, providing a spacer over which is mounted a movable upper switch contact member 38 also formed as a thin, flexibly deformable comb-like metal strip. The upper contact member 38 has an upwardly facing uninterrupted first portion 38*a* forming a rib or main body portion which substantially conforms to and covers the top of the fold-back tape spacer 36 spanning the length of the bar section and has parallel spaced contact finger formations 38*f* extending from the rib or main body portion 38*a* starting at substantially the middle of the upper surface 32 of the bar 30 and protruding to the trailing edge of the bar 30 relative to yarn travel and aligned with the trailing side 30*b* of the rectangular cross section bar 30. The upper contact strip 38 having the fingers 38*f* extending along approximately the trailing half of the strip are formed of copper with gold deposited thereon and are normally maintained spaced above and out of electrical contact with the contact strip portion 34*b* of the lower stationary contact member 34 by the double back tape 36, but are capable of being flexed downwardly into engagement with the contact-point-forming strip 34*b* of the stationary contact member 34 by excessive tension pressure of any of the yarns bearing against fingers 38*b*.

This entire assembly is then covered with a polyethylene sheet, indicated at 40, entirely covering the top of the tight end detector bar assembly formed by the upwardly facing surface of the upper contact member 38 and extending downwardly to entirely cover the leading and trailing sides 30*a*, 30*b* of the bar member 30. The polyethylene sheet cover is flexibly deformable along with the finger portions 38*f* of the upper contact member 38 responsive to predetermined tension forces imposed thereon by the yarn ends passing thereover when excessive tension occurs to establish electrical contact between the metallic portion of the upper moving finger portions 38*f* of contact member 38 and the conductive stripe 34*b* on the lower stationary contact board 36. Electrical lead wires, indicated at 42 extend from the upper moving contact portion 38*a* and the contact point stripe 34*b* of the lower stationary contact 34 to a switch connector member 44 protruding from the bottom of the switch bar assembly for connection to suitable electrical circuitry for illuminating the associated signal lamp 26 designating the switch bar assembly where electrical contact occurred between the contact portions 38*f* and 34*b* caused by excessive tension pressure imposed by one of the yarns on an associated finger portion 38*f*.

In the preferred embodiment, these tight end detector switch assembly bars are made in sections of predetermined length, forming modules which can be assembled on the supporting rail 22 and longitudinally aligned, end-to-end abutting array to span the plurality of yarn ends between the creel header 14 and the top guide along the yarn path leading to the tufting machine for a variety of different feed path widths. By providing a defect signalling lamp 26 for each modular section of the plurality of bar modules or sections making up the total span of the tight end detector assembly, the particular section at which a tight end or defect occur will be identified by the signal lamp which is illuminated. By the present arrangement, the tight ends are detected quickly by activation of the appropriate signal lamp as soon as the end becomes tight enough to exert sufficient force on the associated switch contact finger portion 38*f* to depress it into electrical contacting engagement with the stationary electrical contact stripe 34*b*, enabling the operator to stop the machine and release the end before the end breaks. The particular construction herein described is designed for fast installation on any creel header, and enables attainment of quick sensitivity adjustment at style changes. By providing the polyethylene sheet cover 40, for example of UHMW polyethylene material which is teflon impregnated, and enabling establishment of electrical contact with very slight increases in yarn tension to achieve switch activation, manufacture of the tight end detector assembly is facilitated and extended where surface life is attained.

We claim:

1. A tight end detector for tufting machines and the like for sensing occurrence of yarn tension above a predetermined tightness level in any of a plurality of yarn ends moving along a plural yarn feed path to a textile processing machine and signalling detection of yarn tensions above said tightness level prior to yarn breakage, comprising an elongated tight end detector bar assembly for contacting the yarns spanning the width of the yarn feed path and defining an elongated narrow width planiform contact surface over which the yarns are to be drawn, the yarn contacting bar assembly comprising an elongated hollow tubular rigid bar of rectangular cross section having a narrow yarn-confronting first face joined along lateral edges thereof by side walls forming leading and trailing sides of the bar relative to yarn feed direction along the feed path, a stationary switch-contact-forming PC board having a dielectric base panel fixed to and covering the first face over the whole area thereof and a narrow stripe electrically conductive layer thereon extending along and located slightly inwardly of the lateral PC board edge substantially registering with the trailing side of the bar, a thin spacer strip of electrically insulating material fixed against and covering said PC board over substantially half the width of said first face extending from the lateral edge thereof adjoining said leading side of the bar, a leaf-metal electrical contact member of thin strip material having an uninterrupted spine portion extending at substantially co-extensive covering registry with said spacer strip and fixed therealong to the spacer strip and having parallel spaced contact finger formations protruding therefrom to a contact zone overlying said narrow stripe conductive layer of the PC board with the fingers normally spaced out of electrical contact therewith but being deformable by force of the yarn ends thereon exceeding said predetermined tightness level to be flexed into electrical circuit-making contact with the underlying PC board conductive layer, and thin plastic sheet material covering the first face of the bar and the PC board, spacer strip and leaf-metal contact member surmounted thereon providing a wear surface against which the yarn ends bear during travel along the yarn feed path.

2. A tight end detector for tufting machines and the like for sensing occurrence of yarn tension above a predetermined tightness level in any of a plurality of yarn ends moving along a plural yarn feed path to a textile processing machine and signalling detection of yarn tensions above said tightness level prior to yarn breakage, comprising an elongated tight end detector bar assembly for contacting the yarns spanning the width of the yarn feed path and defining an elongated narrow width planiform contact surface over which the yarns are to be drawn, the yarn contacting bar assembly comprising an elongated hollow tubular rigid bar of rectangular cross section having a narrow yarn-confronting first face joined along lateral edges thereof by parallel side walls forming leading and trailing sides of the bar relative to yarn feed direction along the feed path, a stationary switch-contact-forming PC board having a dielectric base panel fixed to and covering the first face over the whole area thereof and a narrow stripe electrically conductive layer thereon extending along and located slightly inwardly of the lateral PC board edge substantially registering with the trailing side of the bar, a thin spacer strip of electrically insulating material fixed against and covering said PC board over substantially half the width of said first face extending from the lateral edge thereof adjoining said leading side of the bar, a leaf-metal electrical contact member of thin strip material having an uninterrupted spine portion extending at substantially co-extensive covering registry with said spacer strip and fixed therealong to the spacer strip and having parallel spaced contact finger formations protruding therefrom to a contact zone overlying said narrow stripe conductive layer of the PC board with the fingers normally spaced out of electrical contact therewith but being deformable by force of the yarn ends thereon exceeding said predetermined tightness level to be flexed into electrical circuit-making contact with the underlying PC board conductive layer, and a flexibly deformable thin plastic cover sheet of generally channel shaped cross section having a first generally flat panel portion secured against and entirely covering said yarn-confronting first face and the PC board, spacer strip and leaf-metal second contact member surmounted thereon forming a wear surface against which the yarn ends bear during travel along the yarn feed path, the plastic cover sheet having side panel portions extending integrally from said first panel portion and secured against and covering at least the regions of said sides of the bar assembly directly adjoining said first face of said bar.

3. A tight end detector for tufting machines and the like for sensing occurrence of yarn tension above a predetermined tightness level in any of a plurality of yarn ends moving along a plural yarn feed path to a textile processing machine and signalling detection of yarn tensions above said tightness level prior to yarn breakage, comprising an elongated tight end detector bar assembly for contacting the yarns spanning the width of the yarn feed path and defining an elongated narrow width planiform contact surface over which the yarns are to be drawn, the yarn contacting bar assembly comprising an elongated hollow tubular rigid bar of rectangular cross section having a narrow yarn-confronting first face joined along lateral edges thereof by parallel side walls forming leading and trailing sides of the bar relative to yarn feed direction along the feed path, a stationary switch-contact-forming PC board having a dielectric base panel fixed to and covering the first face over the whole area thereof and a narrow stripe electrically conductive layer thereon extending along and located slightly inwardly of the lateral PC board edge substantially registering with the trailing side of the bar, a thin spacer strip of electrically insulating material fixed against and covering said PC board over substantially half the width of said first face extending from the lateral edge thereof adjoining said leading side of the bar, a leaf-metal electrical contact member of thin strip material having an uninterrupted spine portion extending at substantially co-extensive covering registry with said spacer strip and fixed therealong to the spacer strip and having parallel spaced contact finger formations protruding therefrom to a contact zone overlying said narrow stripe conductive layer of the PC board with the fingers normally spaced out of electrical contact therewith but being deformable by force of the yarn ends thereon exceeding said predetermined tightness level to be flexed into electrical circuit-making contact with the underlying PC board conductive layer, and a flexibly deformable thin plastic cover sheet of generally channel shaped cross section having a first generally flat panel portion secured against and entirely covering said yarn-confronting first face and the PC board, spacer strip and leaf-metal contact member surmounted thereon forming a wear surface against which the yarn ends bear during travel along the yarn feed path, the plastic cover sheet having side panel portions extending integrally from said first panel portion and secured against and covering at least the regions of said sides of the bar assembly directly adjoining said first face of said bar, and signalling means including connecting wires coupled to said conductive layer of said PC board and to said leaf-metal contact member and signal lamps and interconnecting circuit means for energizing signal lamps to indicate occurrence and general location of a yarn end exceeding said tightness level.

4. A tight end detector as defined in claim 1, wherein a plurality of said bar assemblies are disposed in serial longitudinal alignment providing a plurality of said bar assemblies in sections of modular form, each modular bar assembly section being allocated to a predetermined assigned width-wise zone spanning a predetermined part of the width of the feed path to be monitored, and signal lamps being respectively associated with a different modular bar assembly section whereby illumination of the signal lamp for an associated section signifies the general region where the detected excessive tightness occurs.

5. A tight end detector as defined in claim 2, wherein a plurality of said bar assemblies are disposed in serial longitudinal alignment providing a plurality of said bar assemblies in sections of modular form, each modular bar assembly section being allocated to a predetermined assigned width-wise zone spanning a predetermined part of the width of the feed path to be monitored, and signal lamps being respectively associated with a different modular bar assembly section whereby illumination of the signal lamp for an associated section signifies the general region where the detected excessive tightness occurs.

6. A tight end detector as defined in claim 3, wherein a plurality of said bar assemblies are disposed in serial longitudinal alignment providing a plurality ,of said bar assemblies in sections of modular form, each modular bar assembly being allocated to a predetermined assigned widthwise zone spanning a predetermined part of the width of the feed path to be monitored, and signal lamps being respectively associated with a different modular bar assembly section whereby illumination of the signal lamp for an associated section signifies the general region where the detected excessive tightness occurs.

7. A tight end detector as defined in claim 1, wherein said thin spacer strip of insulating material is formed of a doubled back tape having pressure sensitive adhesive on the surfaces thereof, said tape being folded along substantially the longitudinal center line thereof providing two folds of the same shape and size covering the area of the half of the PC board adjoining said leading edge and said finger formations of said leaf-metal contact member extending transversely of the elongated bar spaced from and overlying substantially the half of the PC board not covered by the double backed tape.

8. A tight end detector as defined in claim 2, wherein said thin spacer strip of insulating material is formed of a doubled back tape having pressure sensitive adhesive on the surfaces thereof, said tape being folded along substantially the longitudinal center line thereof providing two folds of the same shape and size covering the are of the half of the PC board adjoining said leading edge, and said finger formations of said leaf-metal contact member extending transversely of the elongated bar spaced from and overlying substantially the half of the PC board not covered by the double backed tape.

9. A tight end detector as defined in claim 3, wherein said thin spacer strip of insulating material is formed of a doubled back tape having pressure sensitive adhesive on the surfaces thereof, said tape being folded along substantially the longitudinal center line thereof providing two folds of the same shape and size covering the area of the half of the PC board adjoining said leading edge, and said finger formations of said leaf-metal contact member extending transversely of the elongated bar spaced from and overlying substantially the half of the PC board not covered by the double backed tape.

* * * * *